US005560172A

United States Patent [19]

Brophy et al.

[11] Patent Number: 5,560,172

[45] Date of Patent: Oct. 1, 1996

[54] REDUCER BLOCK FOR RETAINING WALLS

[76] Inventors: Edward A. Brophy, 4941 Milford Rd., Riverside, Calif. 92504; Richard Borish, 4426 Jurupa Ave., Riverside, Calif. 92506

[21] Appl. No.: 292,727

[22] Filed: Aug. 18, 1994

[51] Int. Cl.[6] ..... E04B 5/04

[52] U.S. Cl. ..... 52/596; 52/609; 405/286

[58] Field of Search ..... 52/608, 609, 596, 52/574, 575, 565, 568, 570, 741.13, 741.14; 405/284, 285, 286

[56] References Cited

U.S. PATENT DOCUMENTS

| | | | |
|---|---|---|---|
| 945,439 | 1/1910 | Beidler . | |
| 1,448,078 | 3/1923 | Needham et al. . | |
| 2,011,531 | 8/1935 | Tranchell | 94/11 |
| 2,153,288 | 4/1939 | Walsh | 72/127 |
| 2,624,193 | 1/1953 | Larson | 52/574 X |
| 3,292,331 | 12/1966 | Sams | 52/405 |
| 3,396,504 | 8/1968 | Oliveira | 52/575 |
| 3,826,052 | 7/1974 | Tenorio | 52/293 |
| 4,190,384 | 2/1980 | Neumann | 405/284 |
| 4,537,001 | 8/1985 | Uppstrom | 52/311 |
| 4,569,173 | 2/1986 | Hultquist | 52/293 |
| 4,753,622 | 1/1988 | Nakama | 446/85 |
| 4,909,010 | 3/1990 | Gravier | 405/286 |
| 5,120,164 | 6/1992 | Iacocca et al. | 405/284 |
| 5,221,223 | 6/1993 | Kao | 446/85 |

FOREIGN PATENT DOCUMENTS

| | | | |
|---|---|---|---|
| 2586725 | 3/1987 | France | 405/286 |
| 1811932 | 1/1978 | Germany | 405/286 |
| 229554 | 2/1925 | United Kingdom | 52/609 |
| 2182374 | 5/1987 | United Kingdom | 405/286 |

*Primary Examiner*—Carl D. Friedman
*Assistant Examiner*—Creighton Smith
*Attorney, Agent, or Firm*—Klein & Szekeres

[57] ABSTRACT

A reducer block for effecting the transition, in a block wall, between a course of first blocks which have a first front-to-back thickness, and a course of second blocks which have a second front-to-back thickness that is less than the first thickness, wherein the reducer block has a slanted rear face, whereby the reducer block has a thickness at its bottom surface substantially equal to the first thickness, and a thickness at its top surface substantially equal to the second thickness. A method of constructing a wall with the reducer block comprises the steps of (a) constructing a base portion comprising at least one course of the first blocks; (b) laying a plurality reducer blocks in a single course on top of the uppermost course of the first blocks, so that the bottom surfaces of the reducer blocks are joined to the first blocks; and (c) laying a course of the second blocks on top of the course of reducer blocks, so that the top surfaces of the reducer blocks are joined to the second blocks.

6 Claims, 2 Drawing Sheets

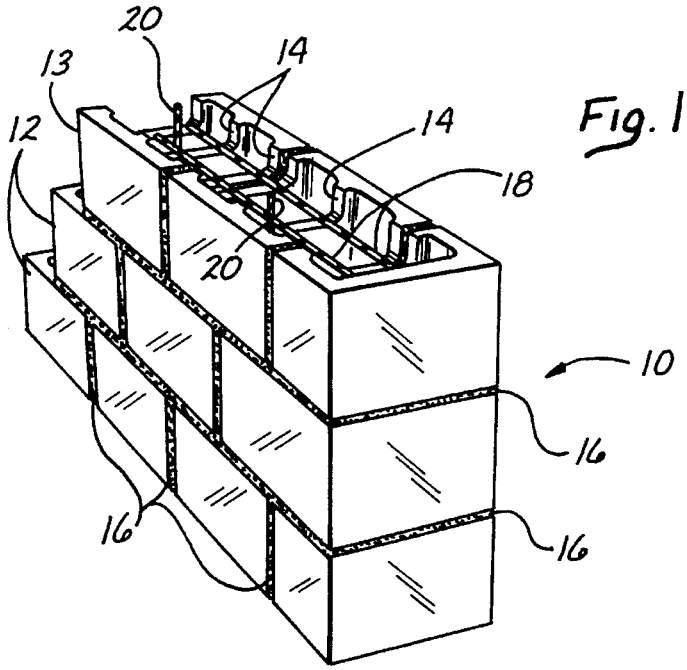
Fig. 1
Fig. 2
PRIOR ART
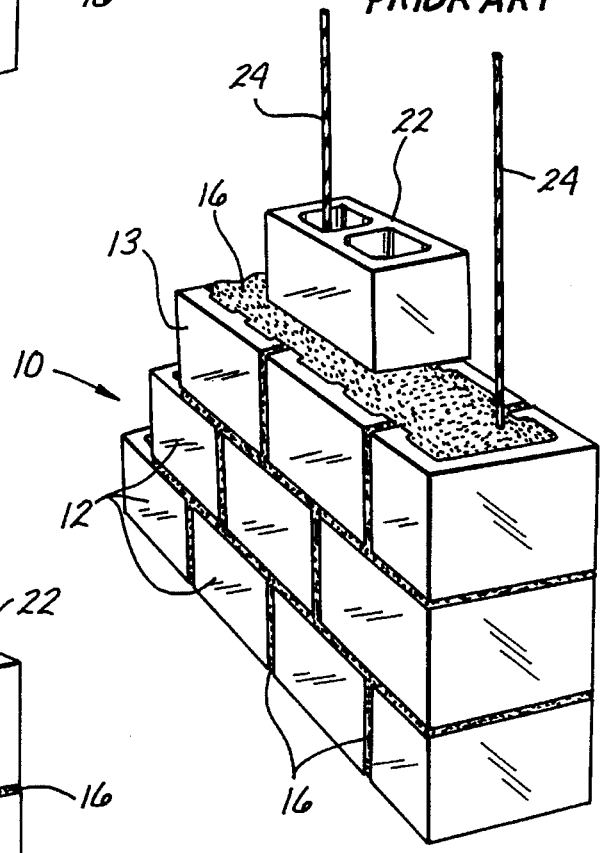
Fig. 3
PRIOR ART
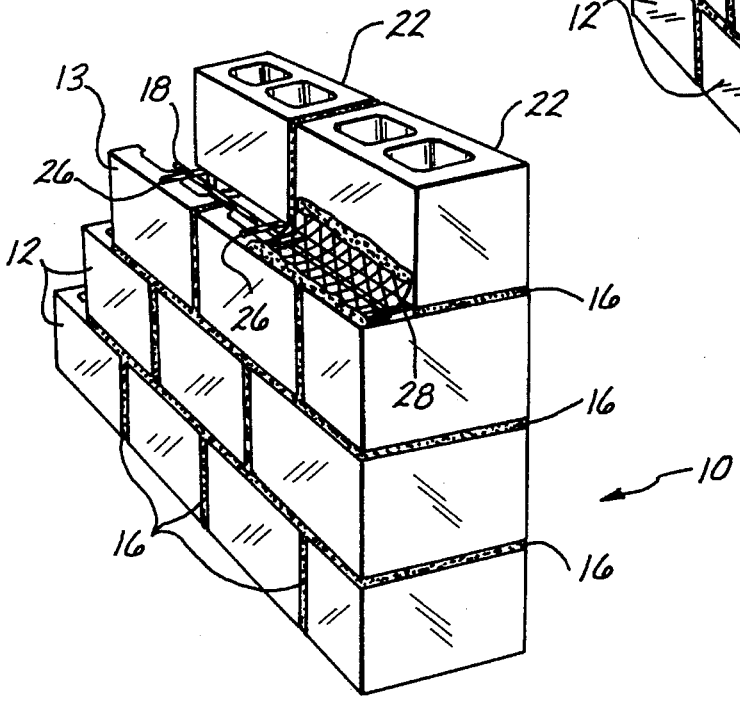

REDUCER BLOCK FOR RETAINING WALLS

BACKGROUND OF THE INVENTION

This invention relates generally to the field of construction blocks of the type used to construct walls. More specifically, it relates to a reducer block used to construct retaining walls and the like, wherein the block is used to create a transition between a thick wall base and a somewhat thinner upper wall portion. The invention also relates to a method of constructing a retaining wall by employing the reducer block.

The building of a block retaining wall, for retaining an earthen slope, presents some unique challenges. One particular problem is presented by the typical need to create a graduated wall thickness, from the base to the top. One approach to this problem is to employ specially-configured blocks, as disclosed, for example, in U.S. Pat. Nos. 2,011,531—Tranchell; 4,190,384—Neumann; and 5,120,164—Iacocca et al. This approach, however, usually results in increased costs, as compared to using the standard concrete or masonry blocks.

If standard concrete or masonry blocks are used, one of several specialized techniques needs to be employed in creating a transition between two successive courses of different block thicknesses or depths. As will be explained below, employing any of these techniques adds to the time and expense of constructing the wall.

It is therefore desired to provide a method for constructing a graduated thickness retaining wall that requires a minimum number of specially-configured blocks, and that requires no specialized techniques in effecting the transition from one wall thickness to another. It also desired to provide a single type of block, simple and inexpensive to make, that can be used in creating the thickness transitions.

SUMMARY OF THE INVENTION

Broadly, the present invention, in one aspect, is a concrete or masonry "reducer" block that decreases in front-to-back thickness, from bottom to top, by means of a slanted rear surface. In another aspect, the present invention is the method of using such a slanted-surface reducer block in forming a single transition course between a lower course of relatively thick base blocks and an upper course of thinner blocks. This method comprises the steps of: (1) laying the desired number of courses of relatively thick base blocks; (2) laying a single course of the novel slanted-surface reducer blocks on top of the uppermost course of the base blocks, with the thicker bottoms of the reducer blocks joined to the base blocks; and (3) laying the desired number of courses of thinner blocks on top of the single course of reducer blocks.

The present invention thus allows a graduated-thickness retaining wall to be built with a minimum number of the specially configured reducer blocks (i.e., a single course), and the transition from a greater wall thickness to a lesser thickness requires no specialized techniques. Furthermore, the reducer block itself is simply and economically manufactured.

These and other advantages of the present invention will be more readily understood from the detailed description that follows.

BRIEF DESCRIPTION OF THE DRAWINGS

FIG. 1 is a partial perspective view of the lower courses of prior art "12-inch" blocks forming the relatively thick base of a concrete block retaining wall, showing the interior of the uppermost course formed of bond beam blocks;

FIG. 2 is a partial perspective view, similar to that of FIG. 1, but showing one prior art method of effecting a transition between the course of bond beam blocks and the lowermost course of relatively thin blocks that form the upper portion of the wall;

FIG. 3 is a partial perspective view, similar to that of FIG. 2, but showing another prior art method of effecting a transition from a course of "12-inch" bond beam blocks to a course of blocks of lesser width;

DETAILED DESCRIPTION OF THE INVENTION

Figure 4:
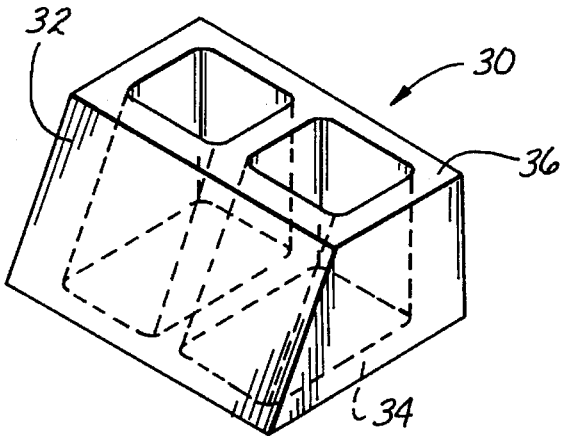
FIG. 4 is a perspective view of a reducer block, in accordance with a preferred embodiment of the present invention.

Before describing the present invention, it is useful to understand the typical prior art methods of constructing a retaining wall having a graduated thickness. These prior art methods are described with reference to FIGS. 1, 2, and 3.

FIG. 1 shows a base portion 10 of a retaining wall formed of typical open-celled concrete or masonry blocks 12. The blocks 12 are typically called "12-inch" blocks, because their thickness (the dimension from the front surface of the wall to the back surface) is slightly less than twelve inches (actually, 11.625 in.) The blocks 12 also typically have a length of 15.625 in. and a height of 7.625 in. The uppermost course of "12-inch" blocks in the base portion 10 is formed of specially configured blocks called "bond beam" blocks 13. The typical bond beam block 13 is characterized by an open interior, traversed by a plurality of transverse partitions or bond beams 14, each of which has an upper and a lower edge with a recessed central portion.

When constructing the wall base 10, typically three courses of "12-inch" blocks are laid (the uppermost course of which is formed of the bond beam blocks 13), producing a base height of about two feet (including the seams of grout or mortar 16). After the uppermost (bond beam block) course of the base 10 is laid, before any grout 16 is applied to join the next course, two or more horizontal steel reinforcing bars ("rebars") 18 are placed longitudinally within the open tops of the bond beam blocks 13, resting in the recessed portions of the bond beams 14. Also, a plurality of vertical rebars 20 are disposed through the open interiors of the "12-inch" blocks 12, 13, typically spaced about 16 in. on center, and terminating at the top of the course of bond beam blocks 13.

After the courses forming the base 10 are laid, the courses forming the upper portion of the wall are laid. These upper courses are thinner than the base 10, typically being formed of thinner, open-celled concrete or masonry blocks that are commonly termed "8-inch" blocks, since their front-to-back thickness is slightly less than eight inches (i. e., 7.625 in.)

FIG. 2 illustrates one prior art method of building a graduated thickness retaining wall, and of effecting a transition from the "12-inch" bond beam blocks 13 of the base 10 to the lowermost course of "8-inch" blocks 22 that form the upper portion of the wall. In this method, when the base 10 is completed, the interiors of the "12-inch" blocks 12, 13 are filled with grout 16, and additional vertical rebars 24 are installed, extending well above the top of the base 10 (and typically close to the top of the entire wall) to assure sufficient vertical stability of the upper wall portion. Thus, when the base 10 is finished, the entire interior of the base 10 is filled with grout 16, to the top of the course of the bond beam blocks 13, thereby creating a firm support for the "8-inch" blocks. The need to fill the interiors of the base-forming blocks 12, 13 adds to both the time and cost of building the wall. In addition, in many jurisdictions, a building inspector is required to inspect the base 10, before it is filled with grout, to assure proper placement of the horizontal rebars 18. This creates inconvenient, and possibly expensive, delays in construction.

FIG. 3 illustrates another prior art method of building a graduated thickness retaining wall, and of effecting a transition from the "12-inch" blocks of the relatively thick base 10 to the "8-inch" blocks of the relatively thin upper portion. In this method, a plurality of transverse rebars 26 are placed laterally across the open tops of the bond beam blocks 13, to serve as supports for the "8-inch" blocks 22. A portion of the open top of each of the bond beam blocks 13 in the uppermost course of the base 10 is left exposed by the lowermost course of "8-inch" blocks 22. To cover this exposed portion, a netting 28 is plastered between each of the lowermost course of "8-inch" blocks 22 and each of the adjacent bond beam blocks 13. The netting 28 is then grouted over to create a closed seal at the transition between the two types of blocks. The requirement of the transverse rebars 26 and the grouted netting 28 results in increased costs of construction, as well as increased construction time.

The above-described problems associated with the prior art methods are substantially minimized, if not eliminated, by the use of a reducer block 30 (FIG. 4), in accordance with a preferred embodiment of the present invention. The reducer block 30 resembles the standard "8-inch" open-celled masonry or concrete block 22, except that it has a rear surface 32 that is slanted, so as to form an acute angle with the reducer block's bottom surface 34 and an obtuse angle with the reducer block's top surface 36. For a standard block height of 7.625 in., these angles are selected so that the thickness of the reducer block 32 at its bottom surface 34 is 11.625 in., (the same thickness as the standard "12-inch" block), while its thickness at its top surface 36 is 7.625 in. (the same thickness as the standard "8-inch" block).

Figure 5:
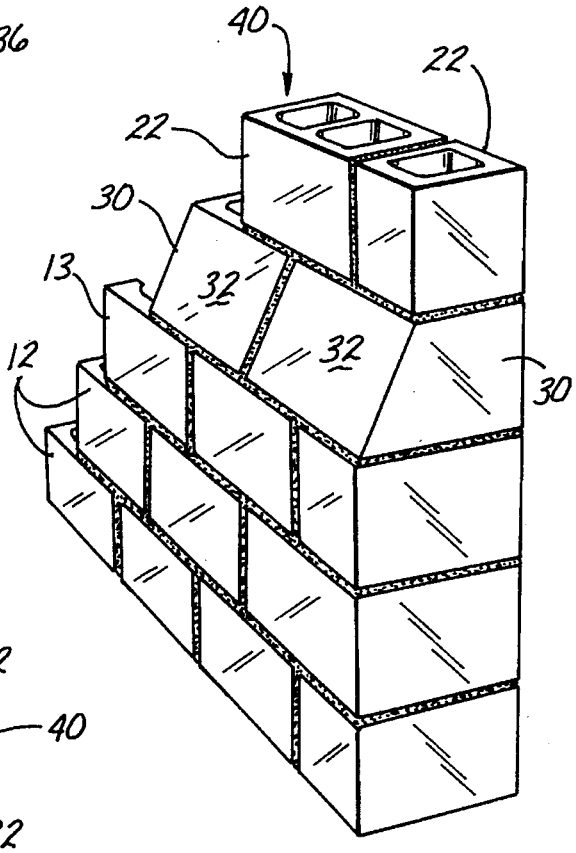
FIG. 5 is a perspective view of a retaining wall constructed with a transition course of reducer blocks, of the type shown in FIG. 4.
Figure 6:
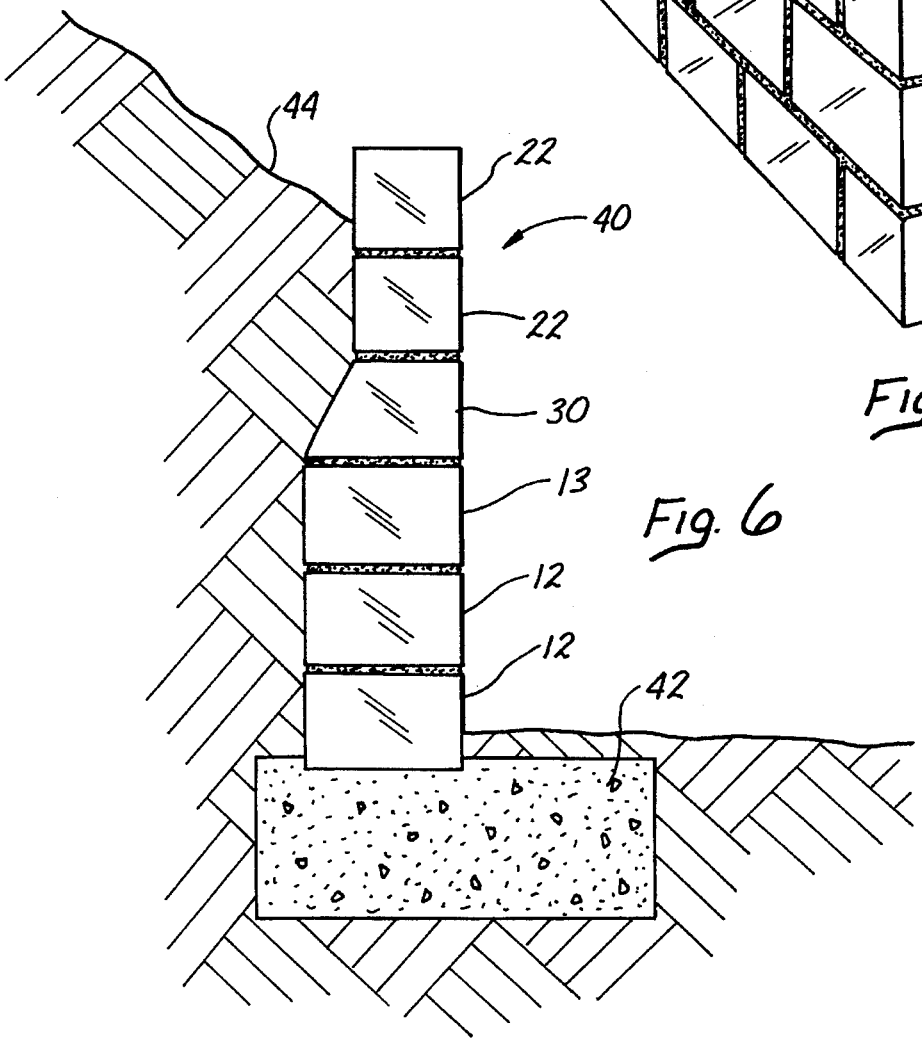
FIG. 6 is a cross-sectional view of the retaining wall of FIG. 5, showing the wall installed to retain an earthen slope.

FIGS. 5 and 6 illustrate the method of constructing a retaining wall 40 using the reducer block 30 of the present invention. The wall 40 has a base 10, constructed of (typically) two courses of standard "12-inch" blocks 12, topped by a single course of "12-inch" bond beam blocks 13, in the manner described above with reference to FIG. 1. The bottom of the base 10 is typically set in a concrete footing 42 (FIG. 6) formed below the surface of the ground, at the bottom of an earthen slope 44 to be retained. On top of the course of bond beam blocks 13 in the base 10, a single course of reducer blocks 30 is laid, with their thicker bottom surfaces 34 joined to the top surfaces of the bond beam blocks 13. The slanted rear surfaces 32 of the reducer blocks 30 are set against the earthen slope 44. A lowermost course of "8-inch" blocks 22 is then laid on the top surfaces 36 of the reducer blocks. Finally, the remaining courses of "8-inch" blocks 22 are laid, until the desired wall height is achieved.

From the foregoing description, it can be seen that present invention allows the construction of graduated thickness retaining walls more quickly and easily, and less expensively, than has heretofore been possible, without sacrificing strength and structural integrity. The novel reducer block 30 of the present invention is easily and inexpensively manufactured, from concrete, masonry, or other materials, and it can be made in a variety of sizes, to accommodate, for example, transitions between wall blocks of nonstandard dimensions.

While a preferred embodiment of the invention has been described above, a number of variations and modifications may suggest themselves to those skilled in the pertinent arts. Such variations and modifications should be considered within the spirit and scope of the invention, as defined in the claims that follow.

What is claimed is:

1. A method of constructing a retaining wall, of the type having a base portion comprising at least one course of first open-celled blocks having a first front-to-back thickness, and an upper portion comprising at least one course of second open-celled blocks having a second front-to-back thickness less than the first thickness, the method comprising the steps of:

(a) constructing the base portion of the wall;

(b) providing a plurality of open-celled reducer blocks, each having a bottom surface at which its thickness is substantially equal to the first thickness, a top surface at which its thickness is substantially equal to the second thickness, a slanted rear surface extending between the top surface and the bottom surface;

(c) laying the reducer blocks in a single course on top of an uppermost course of first blocks, so that the bottom surfaces of the reducer blocks are joined to the first blocks; and (d) laying a single course of second blocks on top of the single course of the reducer blocks, so that the top surfaces of the reducer blocks are joined to the second blocks.

2. The method of claim 1, wherein the slanted rear surface forms an acute angle with the bottom surface and an obtuse angle with the top surface.

3. The method of claim 1, wherein the first thickness is that of a standard "12-inch" construction block, and the second thickness is that of a standard "8-inch" construction block.

4. A retaining wall constructed in accordance with the method of claim 1.

5. The retaining wall of claim 1, wherein the slanted rear surface forms an acute angle with the bottom surface and an obtuse angle with the top surface.

6. The retaining wall of claim 4, wherein the first thickness is that of a standard "12-inch" bond beam block, and the second thickness is that of a standard "8-inch" construction block.

* * * * *